US009937410B2

(12) United States Patent
Greenawalt

(10) Patent No.: US 9,937,410 B2
(45) Date of Patent: Apr. 10, 2018

(54) TILES ON SHAPES PUZZLE GAME

(71) Applicant: Thomas H. Greenawalt, Palm Harbor, FL (US)

(72) Inventor: Thomas H. Greenawalt, Palm Harbor, FL (US)

( * ) Notice: Subject to any disclaimer, the term of this patent is extended or adjusted under 35 U.S.C. 154(b) by 47 days.

(21) Appl. No.: 14/531,409

(22) Filed: Nov. 3, 2014

(65) Prior Publication Data

US 2015/0048570 A1 Feb. 19, 2015

Related U.S. Application Data

(63) Continuation-in-part of application No. PCT/US2012/035967, filed on May 1, 2012.

(51) Int. Cl.

| | |
|---|---|
| ***A63F 3/00*** | (2006.01) |
| ***A63F 3/04*** | (2006.01) |
| *A63F 1/04* | (2006.01) |
| *A63F 11/00* | (2006.01) |

(52) U.S. Cl.

CPC ..... *A63F 3/0423* (2013.01); *A63F 3/00574* (2013.01); *A63F 2001/0483* (2013.01); *A63F 2003/0428* (2013.01); *A63F 2011/0062* (2013.01)

(58) Field of Classification Search

CPC ..... A63F 1/04; A63F 2001/0408; A63F 2001/0441; A63F 2001/0458

USPC ..... 273/282.1, 172, 281, 282.2, 282.3, 283, 273/284, 289, 290, 272; 434/171; 446/117, 118

See application file for complete search history.

(56) References Cited

U.S. PATENT DOCUMENTS

| | | | | |
|---|---|---|---|---|
| 1,327,775 A * | 1/1920 | Platt | G09B 1/36 | 310/87 |
| 1,980,637 A * | 11/1934 | Savory | A63F 3/00176 | 273/272 |
| 2,091,555 A * | 8/1937 | Messinger | G09B 17/00 | 434/172 |
| 4,185,833 A | 1/1980 | McKee | | |
| 2,415,342 A * | 9/1980 | Donner | G09B 17/00 | 273/160 |

(Continued)

OTHER PUBLICATIONS

International Search Report and Written Opinion issued by the International Searching Authority dated Feb. 27, 2013 for international patent application No. PCT/US2012/035967.

International Preliminary Report on Patentability issued by the International Bureau dated Nov. 13, 2014 for international patent application No. PCT/US2012/035967.

*Primary Examiner* — William Pierce

(74) *Attorney, Agent, or Firm* — Robert Varkonyi; Zagrebelsky Law P.A.

(57) ABSTRACT

A tile-on-shape puzzle game is disclosed using a plurality of unique shape designs having one or more tile projections disposed on one or both faces of the shape. The tile projections are adapted to fit in a recess on a play tile. Optional play cards are used to provide clues or shape designations and scores. Shapes are played to form a puzzle, with each player selecting where to place a shape, thereby forming a unique puzzle each time the game is played. Tiles must fill every play space on a shape to form a word or numerical/shape sequence. Gameplay may be varied based on age and skill level, such as limiting the word or sequence direction to left-right, up-down, diagonal, or a combination thereof, or forming pathways with the puzzle.

21 Claims, 9 Drawing Sheets

(56) References Cited

U.S. PATENT DOCUMENTS

| | | | | | |
|---|---|---|---|---|---|
| 4,222,181 | A * | 9/1980 | Cummings | A63F 9/0098 | 40/605 |
| 4,249,336 | A * | 2/1981 | Moe | A63H 3/04 | 248/448 |
| 4,741,538 | A | 5/1988 | Lewis | | |
| 5,035,666 | A * | 7/1991 | Kang | A63F 9/0098 | 446/118 |
| 5,048,840 | A * | 9/1991 | Johnson, Jr. | A63F 3/00214 | 273/241 |
| 5,221,094 | A | 6/1993 | Hanson | | |
| 5,282,631 | A * | 2/1994 | Baker | A63F 3/0423 | 273/153 R |
| 5,769,421 | A | 6/1998 | Wakefield | | |
| 5,860,653 | A * | 1/1999 | Jacobs | G06Q 10/107 | 273/272 |
| 6,769,692 | B1 | 8/2004 | Cavalluzzo | | |
| 6,966,556 | B1 | 11/2005 | Culley et al. | | |
| 7,044,467 | B1 * | 5/2006 | Dimmig | A63F 3/04 | 273/272 |
| 7,267,341 | B2 | 9/2007 | Shah | | |
| 7,695,357 | B2 * | 4/2010 | Fleury | A63F 3/00 | 273/236 |
| 7,789,393 | B2 | 9/2010 | Tucker | | |
| 2011/0084446 | A1 | 4/2011 | Chan | | |
| 2011/0260400 | A1 | 10/2011 | Harrison | | |
| 2013/0341868 | A1 * | 12/2013 | Vandoren | A63F 3/00697 | 273/290 |

* cited by examiner

TILES ON SHAPES PUZZLE GAME

CROSS-REFERENCE TO RELATED APPLICATIONS

This nonprovisional application is a continuation-in-part of PCT Application No. PCT.US2012/035967, entitled "Tiles on Shapes Puzzle Game", filed on May 1, 2012, and claims priority to the application, the contents of which are hereby incorporated by reference.

FIELD OF THE INVENTION

This invention relates to puzzle games. Specifically, the invention is a game utilizing discrete puzzle shapes and tiles in a puzzle-solution game.

BACKGROUND OF THE INVENTION

Education games have been developed as an entertaining way to expand the knowledge base of children and/or adults. Vocabulary and spelling, such as Scrabble®, typically involve placing letter tiles onto a set game board to form a row of words. However, most games only provide one educational skill set at a time. For example, most word games focus just on vocabulary, placing words onto a game board with minimal critical analysis.

Wakefield (U.S. Pat. No. 5,789,421) discloses a word game using tiles and dice. A player is given a letter and rolls the dice to determine the number of tiles to select. The player then selects tiles and attempts to form a word with the tiles.

Cavalluzzo (U.S. Pat. No. 6,769,692) discloses a word game using a gameboard face having rows of playing squares and columns aligning with each row, indicating the number of letter tiles to drawn for forming a word in the corresponding column, the number of letters needed to be played in the row to qualify for a bonus, and the amount of bonus received. Words may be started at any location on the row's playing squares to maximize scoring.

McKee (U.S. Pat. No. 4,185,833) discloses a guessing game using one or more matrix with a code sheet. The code sheet indicates which elements to combine in the matrix to form a line, or other indicia on the matrix, which combine to make up an image or letter. The players are given portions of the letter or word via the matrix code and must guess the letter or word.

Lewis (U.S. Pat. No. 4,741,538) discloses a game where players move an indicated number of spaces onto a board space to purchase the letter indicated on that tile. The object of the game is to form a word that maximizes the player's letters. Once formation of a word, other players landing on the letters of the word must pay a "pay out" fee. The first player to reach a determined amount of money is the winner.

Culley, et al. (U.S. Pat. No. 6,966,556) discloses a card game where players are select a number card, indicating the number of letter cards given to each player, and category card. The players receive letter cards and must make a word pertaining to the category on the category card.

However, the educational word games focus on forming words, with no or minimal focus on other critical thinking skills, like strategy. Puzzle games, such as Blokus®, typically involve placing geometric shapes onto a set game board for a preset challenge. Therefore, what is also needed is a new game that provides education, such as word skills, number skills/mathematics, shape matching skills, color matching skills, and strategy skills, with puzzle solving.

SUMMARY OF THE INVENTION

A tile-on-shape puzzle game is disclosed comprising at least one tile and at least one playing shape. The tiles have an upper face, four edges, and a lower face, with a play indicia disposed on the upper face. Examples of indicia include a letter, number, color, shape, fruit, icon, character, animal, candy, or a combination of indicia. The play indicia are optionally printed onto tile. Exemplary means to print the indicia include hot foil pressed onto the tile, and silk-screen printed onto the tile. A recess disposed on the lower face of the tile. The recess forms a plurality of lips adjacent to the four edges, and is adapted to fit on a tile projection on the shape.

Tiles can be square, octagonal, triangle, circle, hexagon, other geometric shape, curved to fit onto sections of a curved shape, as described below, or three dimensional, such as a house, castle, rock, cube, or other shape known in the art.

The at least one shape has a shape surface with a first face and a second face and at least one tile projection disposed on the first face. The tile projection comprises an elevated surface adapted to fit in the recess disposed on the underside of the tile. The shape may also include at least one tile projection disposed on the second face and corresponding to the inverse location of the at least one tile projection disposed on the first face. The tile protrusion is optionally a square-like octagonal shape, a plurality of cylindrical projections, or a square. The tiles may be optionally fixed to the shapes during play using a textured or friction material, such as those described in Harrison, et al. (U.S. application Ser. No. 12/997,030). Optionally, the friction material is added to the tile recess, the tile projection, or a combination thereof.

The at least one tile and at least one shape may be made of wood, acrylonitrile butadiene styrene (ABS), high impact polystyrene (HIPS), acrylic (PMMA), cellulose acetate, cyclic olefin copolymer (COC), ethylene-vinyl acetate (EVA), ethylene vinyl alcohol (EVOH), polyvinylfluoride (PVF), polyvinylidene fluoride (PVDF), polytetrafluoroethylene (PTFE), polychlorotrifluoroethylene (PCTFE), fluorinated ethylene-propylene (FEP), perfluoroalkoxy polymer (PFA), polyethylenechlorotrifluoroethylene (ECTFE), polyethylenetetrafluoroethylene (ETFE), perfluoropolyether (PCPE), acrylic/PVC polymer, aromatic polyester polymers (liquid crystal polymer), polyoxymethylene (acetal), polyamide (PA, nylon), polyamide-imide (PAI), polyaryletherketone (PAEK), polybutadiene (PBD), polybutylene (PB), polybutylene terephthalate (PBT), polycaprolactone (PCL), polychlorotrifluoroethylene (PCTFE), polyethylene terephthalate (PET), polycyclohexylene dimethylene terephthalate (PCT), polycarbonate (PC), polyhydroxyalkanoate (PHA), polyketone (PK), polyester, polyethylene (PE), polyetheretherketone (PEEK), polyetherimide (PEI), polyethersulfone (PES), chlorinated polyethylene (CPE), polyimide (PI), polylactic acid (PLA), polymethylpentene (PMP), polyphenylene oxide (PPO), polyphenylene sulfide (PPS), polyphthalamide (PPA), polypropylene (PP), polystyrene (PS), polysulfone (PSU), polytrimethylene terephthalate (PTT), polyurethane (PU), polyvinyl acetate (PVA), polyvinyl chloride (PVC), polyvinylidene chloride (PVDC), styrene-acrylonitrile (SAN).

The puzzle game may also include a plurality of play cards, having an indicia face and an obscuring face. The indicia face includes a shape identifier and score value, or a clue. The obscuring face may include the game title, an ornamental design, a picture or other image, or a combination therefore. Other means to obscure the indicia face are known in the art and do not deviate from the invention. The play cards are optionally made of any material known in the art, such as laminated cardboard, high impact polystyrene, wood, acrylonitrile butadiene styrene, acrylic, cellulose acetate, cyclic olefin copolymer, ethylene-vinyl acetate, ethylene vinyl alcohol, polyvinylfluoride, polyvinylidene fluoride, polytetrafluoroethylene, polychlorotrifluoroethylene, fluorinated ethylene-propylene, perfluoroalkoxy polymer, polyethylenechlorotrifluoroethylene, polyethylenetetrafluoroethylene, perfluoropolyether, acrylic/PVC polymer, aromatic polyester polymers, polyoxymethylene, polyamide, polyamide-imide, polyaryletherketone, polybutadiene, polybutylene, polybutylene terephthalate, polycaprolactone, polychlorotrifluoroethylene, polyethylene terephthalate, polycyclohexylene dimethylene terephthalate, polycarbonate, polyhydroxyalkanoate, polyketone, polyester, polyethylene, polyetheretherketone, polyetherimide, polyethersulfone, chlorinated polyethylene, polyimide, polylactic acid, polymethylpentene, polyphenylene oxide, polyphenylene sulfide, polyphthalamide, polypropylene, polystyrene, polysulfone, polytrimethylene terephthalate, polyurethane, polyvinyl acetate, polyvinyl chloride, polyvinylidene chloride, or styrene-acrylonitrile. The play cards may also include uniquely color indicia on the play face which correspond to a color of a shape design. For example, a shape may be molded in a color, such as yellow, red, green or blue with a card having the corresponding shape design on its indicia face and the corresponding color also displayed on the indicia face. Alternatively, only a portion of the shape may be colored, such as the shape surface or the tile protrusion. The remainder of the shape may be molded in a standard color, such as white, wood grain, or beige. The shapes may also include edges that are colored to identify edges that may connect together. For example, where the shapes provide curved bodies with flattened edges, the edges may be colored to identify the surfaces which are eligible for connection to other shapes and the location on the other shape that may accept the curved shape.

The shapes provide puzzles that are solved by connecting new shapes to the existing puzzle and placing tiles on the shapes to form a word, number alignment, word searching, or matched indicia, such as icons, colors, etc. As such, the puzzle is both created and solved simultaneously.

The game includes a plurality of tiles having a tile face and tile underside, with indicia of play is disposed on the tile face of the plurality of tiles. Exemplary indicia include a letter, number, color, shape, fruit, character, animal, icon, or candy. A plurality of playing shapes is also used, as described above. The tiles are optionally shaped as a square-like octagonal shape, a plurality of cylindrical projections, or a square. However, other configurations are known in the art, such as those described Harrison, et al. (U.S. application Ser. No. 12/997,030).

The tiles are mixed together, such as in a bag or pile, and each player selects a plurality of tiles from the bag or pile to form a player's tile pile. The tiles optionally comprise one hundred four single or dual-letter tiles, eight tiles without assigned letter, and twelve tiles designated as an empty space. Shape cards are optionally used with gameplay. The play cards comprise an indicia face and an obscuring face and where the indicia face includes a shape identifier and score value. Optionally, the cards include colors corresponding to the shapes, as described above. The shapes cards are shuffled and at least a portion of the cards dealt to each player prior to play. The remaining cards are placed in a stack with obscuring face facing up. Alternatively, the shape cards are only drawn during a player's turn. For example, in playing with curved shapes, the cards are shuffled and selected at the beginning of a player's turn, indicating the shape that is played during the player's turn.

Play begins by placing a first shape to form a puzzle. Where shape cards are used, the player selects a shape card and collects the shape corresponding to a shape identifier on the shape card. The player must then place one tile from the player's tile piled onto each play surface of the played shape to form at least one word, match, or sequence on the played shape. After successfully playing a shape, the player then plays the shape card, where shape cards are used. Play continues by placing another shape onto the game, such that the new shape contacts at least one other shape on the game to form a game puzzle. The player must then place his or her tiles onto each play surface as before. The first player continues to play shapes until he or she is unable to place shapes down, or cannot form words on every play surface of a shape. At this point, the player replenishes his or her tile pile and shapes or shape cards from the shape card deck. Optionally, if the player successfully connects a shape to more than one existing shape on the puzzle, the player is given a bonus and selects an additional tile for each played shape that connected to more than one shape. Play optionally moves to the next player, with play continuing until a scoring event is triggered, wherein the scoring event is the first player to complete use of the player's shapes, the exhaustion of cards in a shuffled "draw" deck, or every player is unable to place a shape in the same round. The score is then tallied for each player, using played shape cards, played shapes, or the first player to complete use of the player's shapes. For shape cards, the score value disposed on the indicia face is used to tally the player's score. Where a player cannot successfully connect a shape to the puzzle, the player exchanges a plurality of tiles from the player's tile pile, a plurality of shape cards, or a combination thereof.

Also included is an aligning tile-on-shape game comprising letter tiles and playing shapes. The playing shapes have a rectangular shape surface with a plurality of play surfaces disposed on the first face of the playing shape. A plurality of clue cards is used, having an indicia face and an obscuring face; where the indicia face includes a clue. Each clue card originates from a unique category, such as "wild letter", "random letter", "before and after", "rhyme", "starts with", and "categories". The tiles are mixed together in a pile and the clue cards shuffled. Play is initiated by selecting a first clue card and providing a solution to the clue. The solution is optionally between three and five letters. The player then selects tiles from the pile to form the solution and places the solution onto the playing shape. Play continues, using up the play shapes. Alternatively, each player draws 25 tiles randomly, which form the player's tile pile. A single clue card is selected for each round and the clue is used by every player to form the solution, as provided above. Optionally, there are five rounds. At the completion of the rounds, or when every player is unable to place a shape in the same round, play ceases and each player attempts to aligning the playing shapes to form at least one vertical word. Optionally, a round is completed when a player has created a vertical word through moving the straight shapes or reorganizing the shapes and sliding the shapes to align letters vertically.

BRIEF DESCRIPTION OF THE DRAWINGS

For a fuller understanding of the invention, reference should be made to the following detailed description, taken in connection with the accompanying drawings, in which.

DETAILED DESCRIPTION OF THE PREFERRED EMBODIMENT

Disclosed is a unique puzzle game where you are simultaneously creating and solving the puzzle. Shapes are added to the puzzle prior to playing the letter tiles to form words on the shapes, number tiles to play number sequences, equations, icon/color matches, or series, or other shapes. The illustrated variations of the game pieces describe the game used as a word game, although the invention is not limited to such a game and other embodiments of the game using non-letter tiles are envisioned. Further, the shape pieces may be varied in design from the shapes described herein.

Figure 1A:
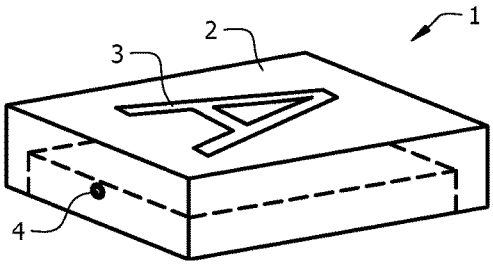
FIGS. 1(A) through (K) are diagrams of a tile used in the present invention. (A) An isometric view of an embodiment of the tile, partially showing the indented recess. (B) A bottom-up view of an embodiment of the tile, showing the square-shaped recess of the tile. (C) A bottom-up view of an embodiment of the tile, showing an octagonal-shaped recess of the tile. (D) A top-down view of an embodiment of the tile, showing an example of fruit play indicia. (E) A top-down view of an embodiment of the tile, showing an example of play instructions. (F) A top-down view of an embodiment of the tile, showing an example of candy play indicia. (G) A top-down view of an embodiment of the tile, showing an example of an animal play indicia. (H) A top-down view of an embodiment of the tile, showing an example of a mathematical operator. (I) A top-down view of an embodiment of the tile, showing two play indicia on the tile surface. (J) A top-down view of an embodiment of the tile, showing square-shaped projection of the tile face and an exemplary play indicia. (K) A top-down view of an embodiment of the tile, showing an octagonal-shaped projection of the tile face and an exemplary play indicia. an example of FIGS. 2(A) through (E) are diagrams of an exemplary shape used in the present invention. (A) An isometric view of the shape, showing the tile projections on one face and partially showing the tile projections on the reverse face. (B) A top down view of the shape, showing the shape design and tile projections. (C) An isometric view of the shape, showing the tile projections molded in color. (D) An isometric view of the shape, showing sqaure tile projections. (E) An isometric view of the shape, showing cylindrical tile projections.
Figure 1B:
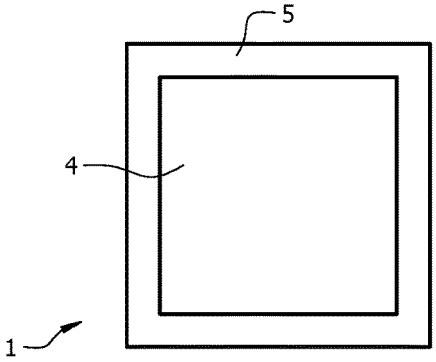
Figure 1C:
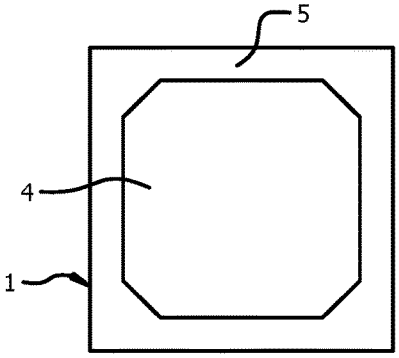
Figure 1D:
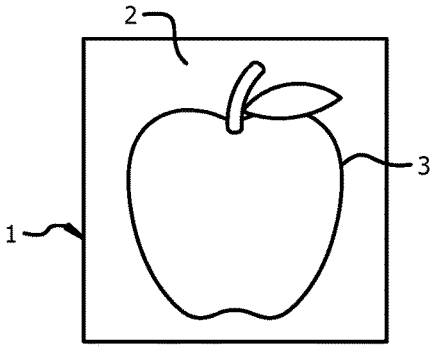
Figure 1E:
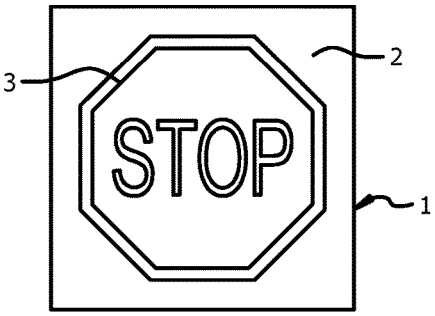
Figure 1F:
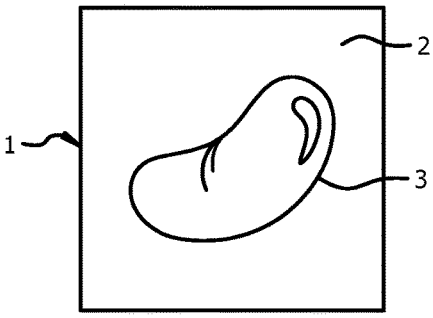
Figure 1G:
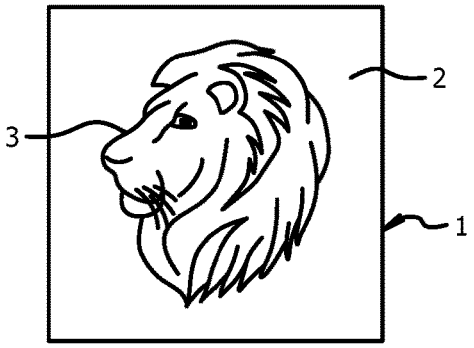
Figure 1H:
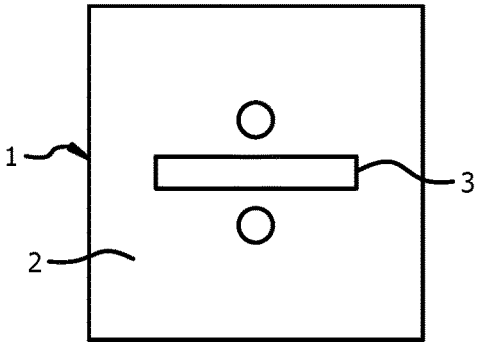
Figure 1I:
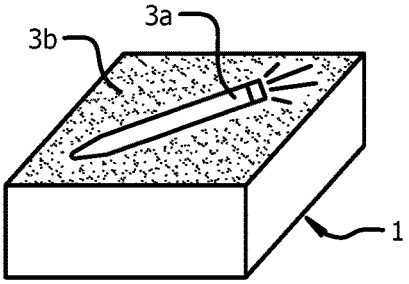

The game consists of tiles 1 which fit onto predesigned shapes 10 to form at least one word. Tile 1 may be formed of high impact polystyrene (HIPS), acrylonitrile butadiene styrene (ABS), wood or other material known in the art. Tile 1 consists of tile face 2, containing play indicia 3, as seen in FIG. 1(A). Play indicia 3 can be, for example, a letter, number, color, shape, or other design permitting matching of design or sequence and is printed onto tile 1 by means known in the art, such as hot foil or silk-screen printing. The underside of tile 1 is adapted to fit onto shape 2 and includes recess 4 surrounded by lip 5, as seen in FIG. 1(B). Alternatively, tile 1 includes recess 4 shaped as a square-like octagonal recess, as seen in FIG. 1(C), or a plurality of cylindrical projections. Play indicia include fruit, as seen in FIG. 1(D), board game play instructions, as seen in FIG. 1(E), candy, as seen in FIG. 1(F), animals, as seen in FIG. 1(G), or mathematical operators, such as in FIG. 1(H). In some variations, tile 1 includes a plurality of play indicia, such as first play indicia 3*a* and second play indicia 3*b*, as seen in FIG. 1(I). As seen in the illustrative example depicted in the image, first play indicia 3*a* is shown as a play icon, and second play indicia 3*b* shown as a color. However, the tiles can be marked by play indicia as would be obvious to one of skill in the art, upon examination of the specification.

For word games, play indicia 3 is a letter, a combination of two letters together, such as "QU", a "wild" (★) tile, or a "block" (■) tile. The "wild" tiles can be played as any letter, provided such use forms a word in any direction. The "block" tile, the position on the shape is blocked out, permitting a player to form separate words in the same direction on the same shape. Also, new shapes may be connected to block tiles.

Figure 2A:
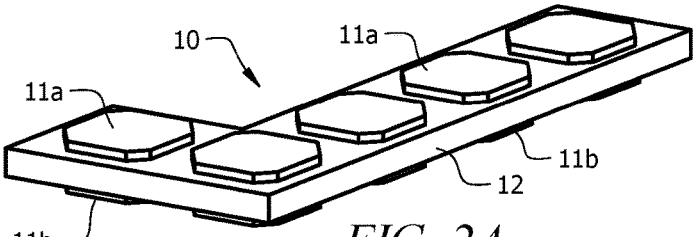
Figure 2B:
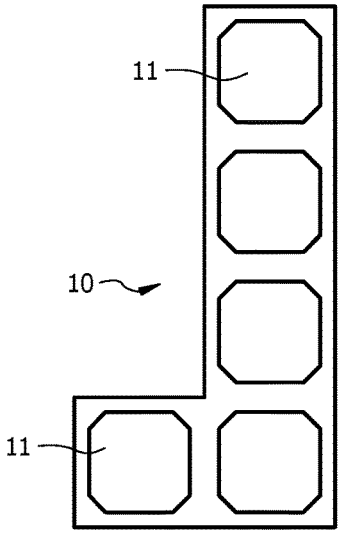
Figure 2C:
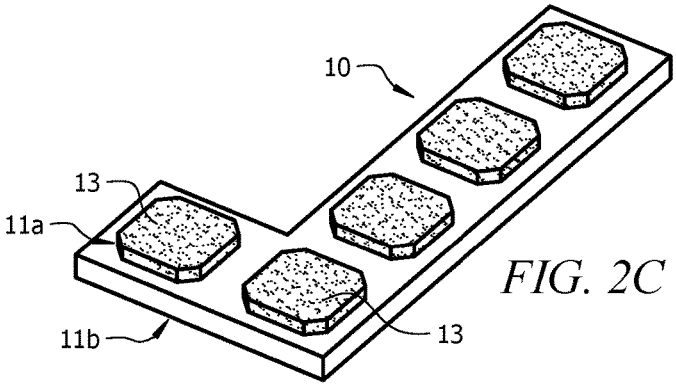
Figure 2D:
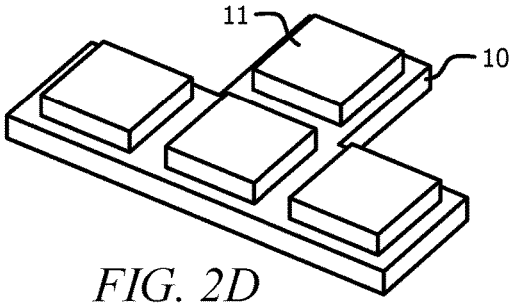
Figure 2E:
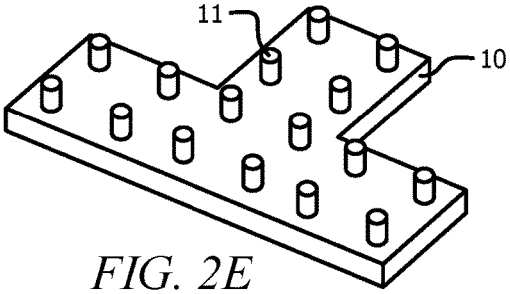
Figure 3:
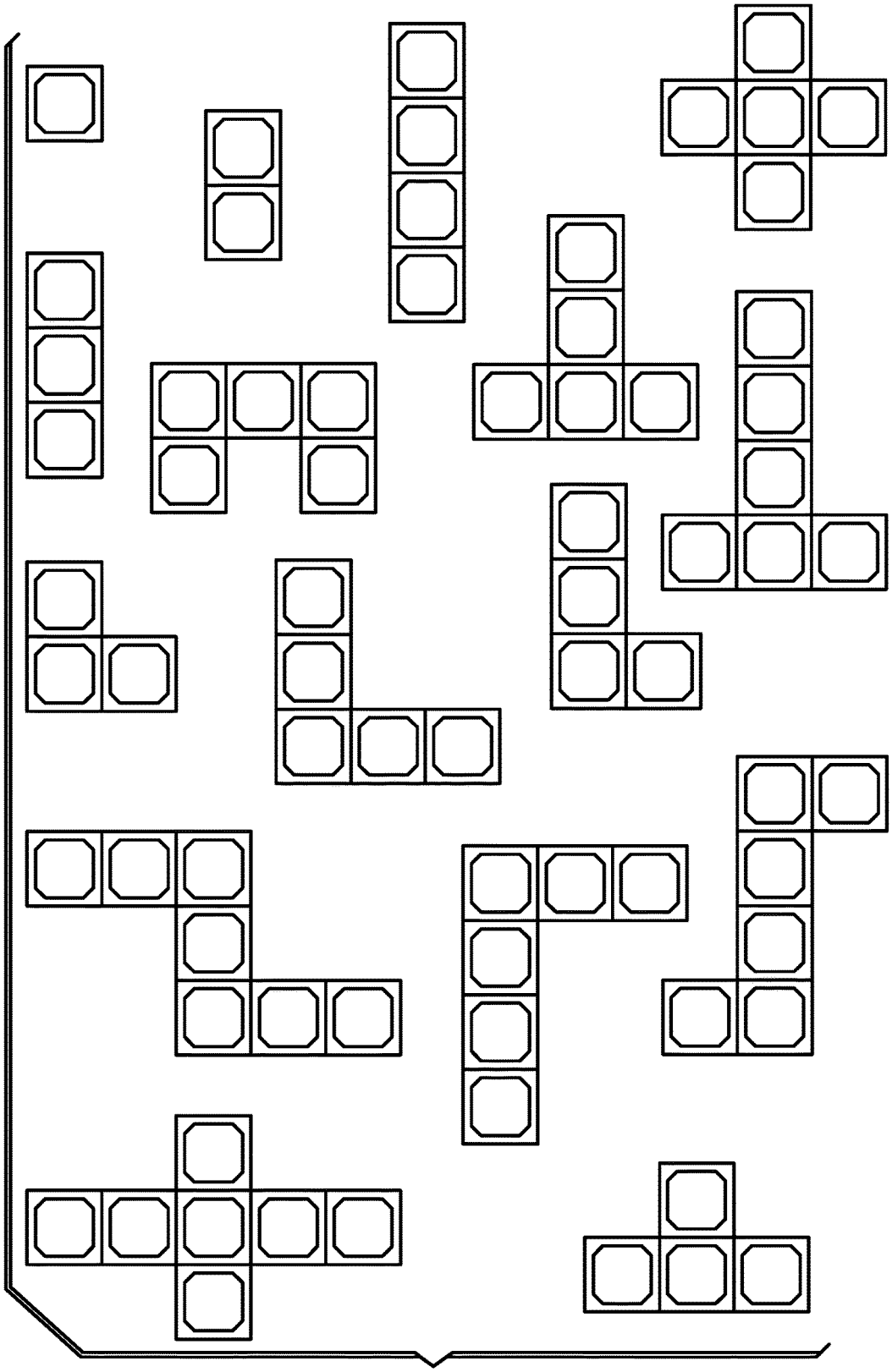
FIG. 3 is a plurality of diagrams showing the shape designs in one embodiment of the present invention.

Shape 10 is formed of high impact polystyrene (HIPS), acrylonitrile butadiene styrene (ABS), or other material known in the art, and includes at least one tile protrusion 11 on each side of shape form 12, as seen in FIG. 2(A). Tile protrusions 11 project from shape 10 and have a square-like octagonal shape, as seen in FIG. 2(B), square shaped projections, as seen in FIG. 2(D), or cylindrical projections, as seen in FIG. 2(E), designed to fit into recess 4. Tile protrusions 11*a* provide play surfaces on one side of the shape, while tile protrusions 11*b* provide play surfaces on the inverse face of the shape, permitting a player to orient the shapes for game play as he or she desires. There are 16 distinct tile shapes, as seen in FIG. 3. While it is within the scope of the invention to only provide tile protrusions on one side of the shape, some shapes are orientated such that the shape is symmetric about a vertical axis (horizontally flipped) or about a horizontal axis (vertically flipped), which increase the difficulty of the game play.

In some embodiments, tile protrusion 11 is at least 1/16 inch thick and recess 4 is at least 3/64 inch deep, thereby ensuring tile 1 is secured onto shape 10. Tile protrusion 11 is designed to fit securely within recess 4. For example, recess 4 may be 5/8 inch by 5/8 inch by 3/64 inch deep with corresponding octagonal tile protrusion dimensions of 9/16 inch by 9/16 inch by 1/16 inch thick, and 1/8 inch of the corner edge removed at a 45° angle forming the octagonal shape. The interior face of lip 5 optionally includes a textured or friction material to further secure the tile onto shape 10. Alternatively, the exterior face of tile protrusion 11 may include the textured or friction material or both the tile protrusion and lip both include the texture or friction material.

Figure 4A:
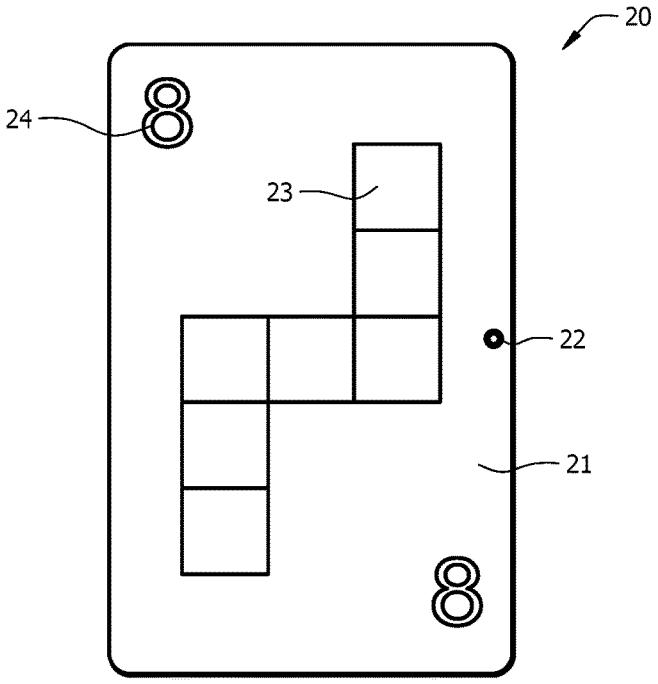
FIGS. 4(A) through (C) are diagrams of a shape card, showing the indicia face of the card, and an exemplary die. (A) The indicia face of the shape card showing score values and the designated shape; and (B) the indicia face of the shape card showing only the designated shape. (C) An isometric view of an exemplary die.

Shape cards 20 are formed of any material known in the art, such as laminated cardboard, high impact polystyrene (HIPS) or acrylonitrile butadiene styrene (ABS). Shape card 20 has an indica face 21 and an obscuring face 22. Obscuring face 22 may include the game's title or other design, preventing a player from identifying the markings on the indicia face of the card. Indicia face 21 includes shape identifier 23 and score value 24, thereby identifying the shape to be played and the score associated with the identified shape. Optionally, the shapes are uniquely colored, corresponding to the shape and number of spaces, and also correspond to color indicia on shape cards 20, thereby permitting simplified identification of the play shape. For example, where shape card 20 displays a seven-space shape, as indicated in FIG. 4(A), the color of the printing can be yellow. The corresponding shape 10 can be molded in yellow or shape form 12 can be molded in yellow with tile protrusion 11 being a standard color or tile protrusion 11 molded in yellow with shape form 12 molded in a standard color, such as white or beige, as depicted in FIG. 2(C).

Example 1

This variation uses a turn-based game using thirty-two shapes 10 in sixteen distinct designs, as seen in FIG. 3. Shapes 10 are assigned varying point values ranging from one to eight. Thirty-two shape cards 20, corresponding to each of shapes 10 are used to designate the point value for each shape and indicate which shapes a player is assigned to play. The games uses one hundred twenty-four tiles 1, which include one hundred four assigned letter tiles, eight "wild" letters that can be used as any letter, and twelve "block" tiles that function as a blank space to permit multiple words on a shape.

Shapes 10 are placed together on a playing surface, such as a table, ensuring there is adequate space to play and connect shapes. Tiles 1 are placed into a bag and mixed. Each player selects eight tiles from the bag and places the tiles in front of the player. Shape cards 20 are shuffled and cards dealt to each player. For four players, three cards are dealt to each player. For two or three players, four shape cards are dealt to each player. The remaining shape cards are placed on the table with obscuring face 22 facing up. Each player selects a single tile from tile bag to determine the starting player and then returns the tile to the bag. The player with the letter closest to "A", not including the wild or the block, goes first. Play moves clockwise.

Figure 5A:
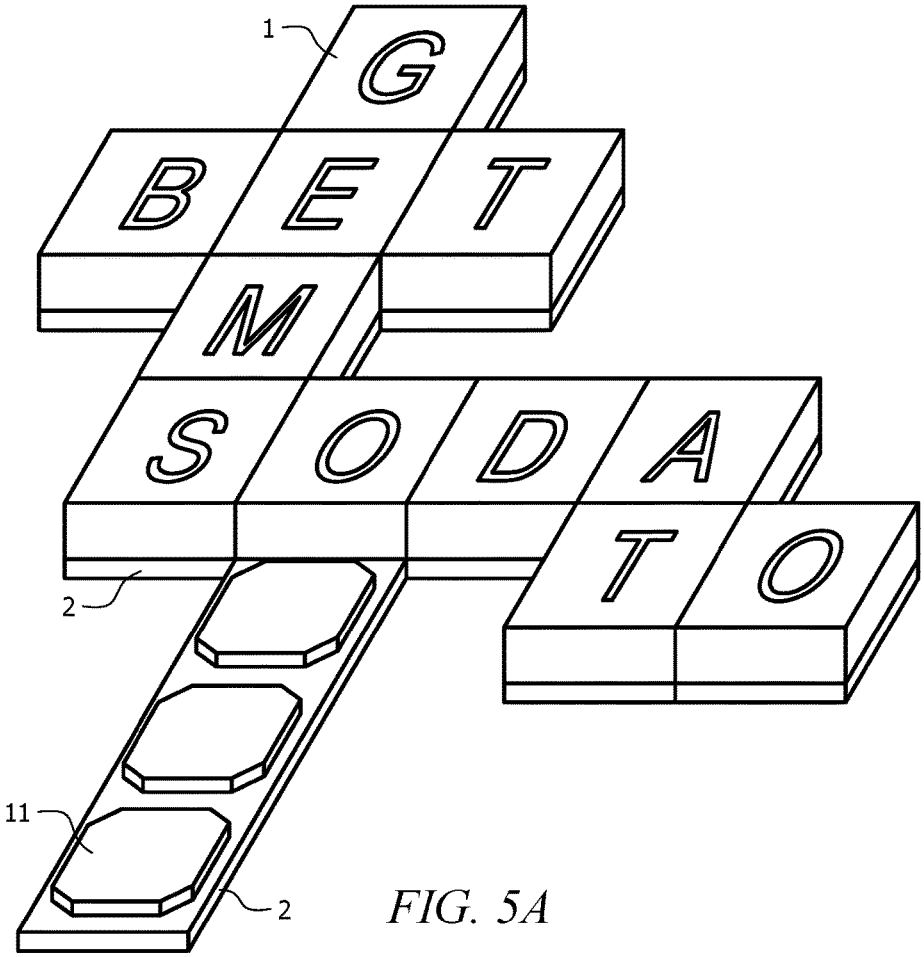
FIGS. 5(A) and (B) are an isometric view of a (A) puzzle of the present invention and (B) optional tile holder.
Figure 5B:
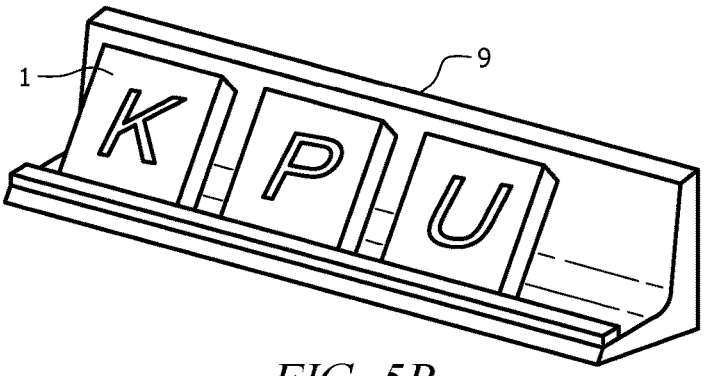

During a turn, the player selects at least one shape card 20 and collects a shape corresponding to shape identifier 23 on the shape card. Shape 10 is placed on the table, with each shape played connecting to one or more shapes previously played, i.e. the new shape connecting to puzzle 8, with the exception of the first shape played in the game, to form puzzle 8, as seen in FIG. 5. Placement of the shape is dictated by the player's ability to form a word using the letter adjacent to the played shape and strategic use of shapes to prevent other players from successfully playing shapes, especially high value shapes. Tiles 1 are selected from the player's tiles 1*a*, which are optionally stored on tile rack 9 until needed, and placed onto each tile protrusion 11 of shape 10 forming one or more words in any direction. To successfully play a shape, tiles 1 must be placed on every tile protrusion 11 of shape 10, with a two letter minimum word. Additionally, the letter on a played space "connected" shape space must be used as part of the word on the newly placed shape. Where a "wild" tile is used, the "wild" letter is not a fixed letter during play, i.e. the "wild" letter is changed by each player connecting to the wild tile based on the player's needs. Strategic use of the "wild" or the "block" letter, as well as placement of the shape, alters gameplay by blocking a player's access to a shape placement or permitting play. Abbreviations, acronyms, proper names, or hyphened words are not permitted. Alternatively, for a classic looking and challenging game, words must be formed left-to-right or top-to-bottom. Where the player can successfully play multiple shapes, the player continues adding shapes to the puzzle If a shape cannot be played, any or all tiles 1 or shape cards 20 may be exchanged by discarding the unwanted tiles and/or cards and selecting shape cards from the shuffled deck and tiles from the tile bag.

Upon completing a turn, the player places the shape cards representing the successfully played shapes in front of the player for later scoring. The player then replenishes the player's tiles 1*a* from the tile bag to reach eight tiles, and replenishes any played shape cards from the shape card deck. Where a player successfully connected a shape to more than one existing shape on puzzle 9, the player is given a bonus and draws an additional tile for each played shape that connected to more than one shape.

Play continues until a player has played all of that player's shape cards and the shuffled "draw" deck is exhausted, or every player is unable to place a shape in the same round. At the end of play, shape cards are used to determine score. Score value 24 on the shape cards that were successfully played are tallied, with score values on the shape cards remaining in a player's hand, i.e. unplayed shapes, at the end of the game are deducted from the total. The winner is the player with the most total points. Where two players have the same score, the tie breaker goes to the player with the highest value shape card successfully used.

Example 2

Gameplay is similar to Example 1, but provides for a shorter game. Each player randomly selects eight shape cards 20 from the shape deck and selects ten tiles 1. Gameplay continues as described in Example 1, without replacing the shape cards. Play ends when a player exhausts his or her shape cards, or when all players cannot successfully play a shape in a single round.

Example 3

Gameplay is similar to Example 1, but provides for a shorter game. Each player randomly selects ten tiles 1. Each player concurrently selects a shape and plays his or her tiles, and continues to play until the player is unable to successfully play a shape, use his or her tiles, or both, depending on the game. As such, every player is playing at the same time. Gameplay continues as until all players exhaust his or her shape cards, or when all players cannot successfully play a shape.

Example 4

Gameplay is similar to Example 1, but tiles 1 are imprinted with numbers, from one through six, as indicia 3 on tile face 2. Shape 10 is played on the puzzle such that a numerical sequence or parity, i.e. odd or even numbers, can be formed, using every tile projection 11 on shape 10. Tiles 1 are then placed onto shape 10 to form a sequence or parity. Non-limiting examples of sequences are prime numbers, sequences of square numbers, sequences of square root numbers, Fibonacci sequence, Lucas sequence, and mathematical equations. An example of a successful mathematical equation sequence could be 4, 3, and 1 representing 4 minus 3 equals 1. Tile 1 also includes "wild" and "block" tiles. As in Example 1, "wild" tiles may be changed to any number by each player connecting to the wild tile based on the player's needs, and "block" tiles are used to stop a numerical sequence or parity.

Play continues as described in Example 1, until a player has played all of that player's shape cards and the shuffled "draw" deck is exhausted, or every player is unable to place a shape in the same round. At the end of play, score value 24 on the shape cards that were successfully played are tallied, with score values on the shape cards remaining in a player's hand, i.e. unplayed shapes, at the end of the game are deducted from the total. The winner is the player with the most total points. Where two players have the same score, the tie breaker goes to the player with the highest value shape card successfully used.

Example 5

Gameplay is similar to Example 1, but tiles 1 are imprinted with icons or color combinations, as indicia 3 on tile face 2. In some embodiments, the tiles are three distinct icon designs or three colors combinations. Shape 10 is played on the puzzle such that a single color/icon tiles in lines of matching color or icon can be formed, using every tile projection 11 on shape 10. Tiles 1 are then placed onto shape 10 to form a matching color or icon sequence. Tile 1 also includes "wild" and "block" tiles. As in Example 1, "wild" tiles may be changed to any color or icon by each player connecting to the wild tile based on the player's needs, and "block" tiles are used to stop a sequence. In embodiments which match tiles, such as color or icon, the shape is placed with color or icon imprinted on the player's tiles matching the color or icon of the adjacent tiles on the puzzle. Alternatively, the tiles may be matched based on categories, such as citrus fruits being played together, pomaceous fruits (apples, pears, Japanese plum) played together, berries played together, etc.

Play continues as described in Example 1, until a player has played all of that player's shape cards and the shuffled "draw" deck is exhausted, or every player is unable to place a shape in the same round. At the end of play, score value 24 on the shape cards that were successfully played are tallied, with score values on the shape cards remaining in a player's hand, i.e. unplayed shapes, at the end of the game are deducted from the total. The winner is the player with the most total points. Where two players have the same score, the tie breaker goes to the player with the highest value shape card successfully used.

Example 6

Figure 6:
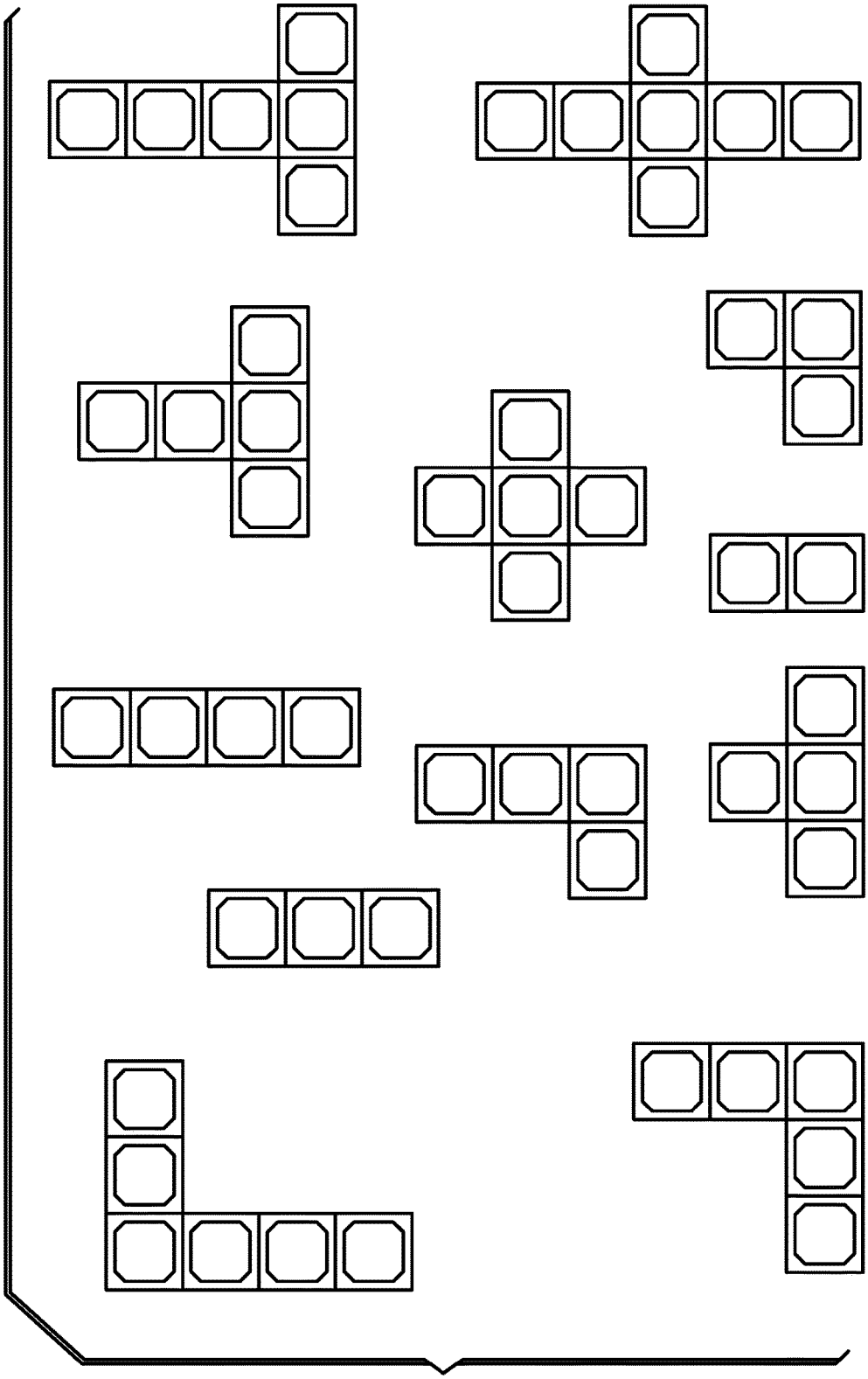
FIG. 6 is a plurality of diagrams of the shape designs of the present invention for the timed game embodiment.

This variation is a time-based game using forty-eight shapes 10 in twelve distinct designs, with each distinct design of four shapes, as seen in FIG. 6. Shapes 10 are assigned varying point values ranging from one to eight. Thirty-two shape cards 20, corresponding to each of shapes 10 are used to designate the point value for each shape and indicate which shapes a player is assigned to play. The games uses one hundred twenty-four tiles 1, which include one hundred four assigned letter tiles, eight "wild" letters that can be used as any letter, and twelve "block" tiles that function as a space to permit multiple words on a shape.

Figure 4B:
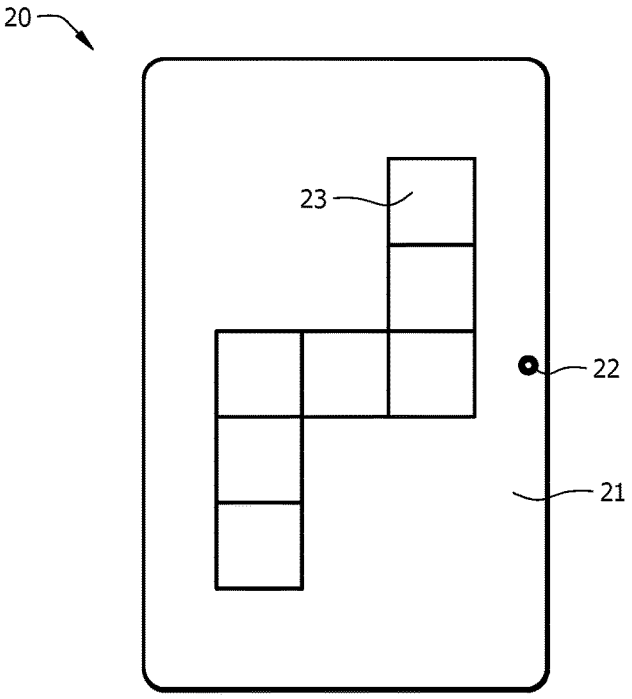

Shape cards 20 are shuffled and three to four cards dealt to each player. In some embodiments, each player is given the same shape cards. Alternatively, each player selects the shape cards, such as four cards, for play. The remaining shape cards are placed deck face down on the table. In some embodiments, the values on the shape cards are used to determine the number of tiles the player is permitted to collect for the player's tile pile. Alternatively, shape cards 20 do not have any score values 24, as seen in FIG. 4(B). It is envisioned that shape cards 20 are split into four equal decks, having the same assigned shapes in each deck such that each player has access to all available shapes. Alternatively, shape cards 20 are not used, and each player is given the same shapes, i.e. same designs, and instructed which three or four shapes are to be used to start play.

Shapes 10 are placed together on a playing surface, such as a table, ensuring there is adequate space to play and connect shapes. Tiles 1 are placed into a bag and mixed, and each player randomly selects twenty-four tiles from the bag and places the tiles face down in front of the player. For a more challenging game, each player starts with the same number of tiles as on the total spaces on the four initial shapes. For example, where each player is give a "2-tile protrusion" shape, a "4-tile protrusion" shape, a "6-tile protrusion" shape, and a "1-tile protrusion" shape, the player selects thirteen tiles.

Shapes 10 are placed together on a playing surface, such as a table, ensuring there is adequate space to play and connect shapes. Alternatively, each player is given a collection of shapes 10 for play. After each player has selected their tiles and shapes, play begins with each player independently creating his or her own puzzle using the shapes and tiles to for words. To successfully play a shape, tiles 1 must be placed on every tile protrusion 11 of shape 10, with a two letter minimum word. Additionally, the letter on a played space "connected" shape space must be used as part of the word on the newly placed shape. Where a "wild" tile is used, the "wild" letter is not a fixed letter during play, i.e. the "wild" letter is changed by each player connecting to the wild tile based on the player's needs. Abbreviations, acronyms, proper names, or hyphened words are not permitted. Shape 10 is placed on the table, with each shape played connecting to one or more shapes already played, with the exception of the first shape played in the game, to form puzzle 8, as seen in FIG. 5. Tiles 1 may be placed on tile protrusions 11 in any direction to form a word; left-to-right, right-to-left, top-to-bottom, or bottom-to-top direction.

Alternatively, for a classic looking and challenging game, words must be formed left-to-right or top-to-bottom.

Where a player cannot successfully play any shapes, the player yells "stumped" and draws six additional tiles, along with the next shape card in the card deck. It is noted that the game provides enough tiles for 4 additional sets of shapes and tiles. For further challenge, in a "Stumped" situation, the player draws the next shape card 20 in the deck, and only selects additional tiles equal to the spaces on your additional shape. For example, where the "stumped" player selected a "2-tile protrusion" shape, the player selects two additional tiles. Play continues until a player has successfully created words on all of their shape cards or every player is unable to place a shape on their respective complete puzzle.

The winner is the player to complete their puzzle first, i.e. to use all the shape cards 20 in their hand. On a mutually agreed upon "stopped" round, the winner of the round is the player with the fewest shapes. The tiebreaker is the player with the fewest empty spaces. For extended play, play continues for an additional round or rounds by placing shape cards 20 back in the deck and the letter tiles placed in the bag and starting new puzzles. The winner is the first player to win 3 rounds (with 4 players), to 4 rounds (with 3 players), and to 5 rounds (with 2 players).

Example 7

Gameplay is similar to Example 6, but tiles 1 are imprinted with numbers, from one through six, as indicia 3 on tile face 2. Shape 10 is played on the puzzle such that a numerical sequence or parity, i.e. odd or even numbers, can be formed, using every tile projection 11 on shape 10. Tiles 1 are then placed onto shape 10 to form a sequence or parity. Non-limiting examples of sequences are prime numbers, sequences of square numbers, sequences of square root numbers, Fibonacci sequence, Lucas sequence. Tile 1 also includes "wild" and "block" tiles. As in Example 6, "wild" tiles may be changed to any number connecting to the wild tile based on the player's needs, and "block" tiles are used to stop a numerical sequence or parity.

Play continues as described in Example 6, until a player has played all of that player's drawn shape cards, or every player is unable to place a shape. At the end of play, the winner is the player to complete their puzzle first, i.e. to use all the shape cards 20 in their hand. On a mutually agreed upon "stopped" round, the winner of the round is the player with the fewest shapes. The tiebreaker is the player with the fewest empty spaces. For extended play, play continues for an additional round or rounds by placing shape cards 20 back in the deck and the letter tiles placed in the bag and starting new puzzles. The winner is the first player to win 3 rounds (with 4 players), to 4 rounds (with 3 players), and to 5 rounds (with 2 players).

Example 8

Gameplay is similar to Example 6, but tiles 1 are imprinted with icons or color combinations, as indicia 3 on tile face 2. In some embodiments, the tiles are three distinct icon designs or three colors combinations. Shape 10 is played on the puzzle such that a single color/icon tiles in lines of matching color or icon can be formed, using every tile projection 11 on shape 10. Tiles 1 are then placed onto shape 10 to form a matching color or icon sequence. Tile 1 also includes "wild" and "block" tiles. As in Example 6, "wild" tiles may be changed to any color or icon by each player connecting to the wild tile based on the player's needs, and "block" tiles are used to stop a sequence.

Play continues as described in Example 6, until a player has played all of that player's drawn shape cards, or every player is unable to place a shape. At the end of play, the winner is the player to complete their puzzle first, i.e. to use all the shape cards 20 in their hand. On a mutually agreed upon "stopped" round, the winner of the round is the player with the fewest shapes. The tiebreaker is the player with the fewest empty spaces. For extended play, play continues for an additional round or rounds by placing shape cards 20 back in the deck and the letter tiles placed in the bag and starting new puzzles. The winner is the first player to win 3 rounds (with 4 players), to 4 rounds (with 3 players), and to 5 rounds (with 2 players).

Example 9

Play piece 50 has a linear shape and five spaces on each piece. The five spaces are optionally tile protrusions 11, as described above. Clue cards 55 are also provided, and may be made of any material which is used to form shape cards 20. Exemplary clue cards include "wild letter", "random letter", "before and after", "rhyme", "starts with", and "categories". However, other types of clue categories may be provided, as would be apparent to one skilled in the art.

A series of five play pieces 50 are given to each player. Tiles 1 having letters imprinted on the face are provided in a "community" location, where each player has access to the same pool of tiles 1, with wild letters randomly available. Clue cards 55 are arranged in clue categories and each clue category shuffles. Each player is given five clue cards, corresponding to each of the five play pieces 50. Each clue card originates from a unique category, i.e. no clue categories are repeated, and each player is given clue cards from the same categories.

Figure 9:
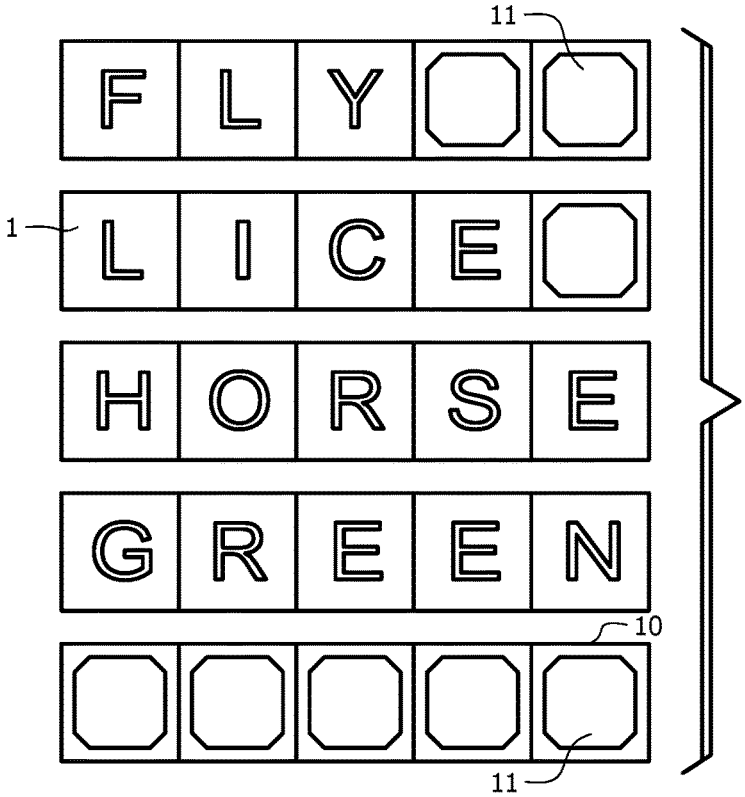
FIG. 9 is a diagram of an exemplary game using straight shapes in a clue-based word game.

Play begins once every player received his or her clue cards and tiles. Each player reviews the clue provided on clue card 55 and develops a word solution to the clue. Each word must contain between three and five letters. Upon forming a solution, the player collects tiles from the common pool of tiles 56 and places the tiles onto play piece 50 which corresponds to the clue. For example, a player is given a "before and after" clue stating the following "butter swatter". The player collects the letters "F", "L", and "Y", and places them onto the appropriate play piece 50, spelling out "fly", as seen in FIG. 9. In some variations, the player must complete a clue before he or she may move to the next clue card.

In some instances, there are a limited number of tiles 1, requiring a player to form a new solution to a clue. For example, the clue may be "a color". The player's first solution may be "blue", but upon collecting the requisite tiles, the player realizes the "B" tile has been played. The player then forms a new solution, such as "green" and collects the tiles for the new solution, playing them on play piece 50.

The gameplay finishes when the first player completes all five columns or all players can no longer form words with the remaining clues and tiles. At this point, each player attempts to align columns to form words vertically. Alternately, game play continues until a player can form a vertical word by aligning the shapes. In some variations, a sixth clue card is used to provide a clue for solving the vertical word. In such variations, the players must align the shapes to form a solution to the sixth clue. Once complete, each player's scores are tallied as follows: one point for every letter played per column, 5 points are awarded to the first player to complete all five clues, and 1 point is awarded to each letter used to form a vertical word. The player with the highest score wins.

In an alternative variation of the game, each player collects 5 strip shapes and twenty-five letter tiles. A single clue card is selected and the tiles are placed onto the shapes. The tiles do not need to form words. The shapes are then aligned and positioned to form a vertical word or words. Players earn points by solving the clue first, which is awarded 5 bonus points. One point is awarded for each letter used to form a vertical word letter, and ten bonus points awarded for each vertical word that answers the clue.

Example 10

Figure 7:
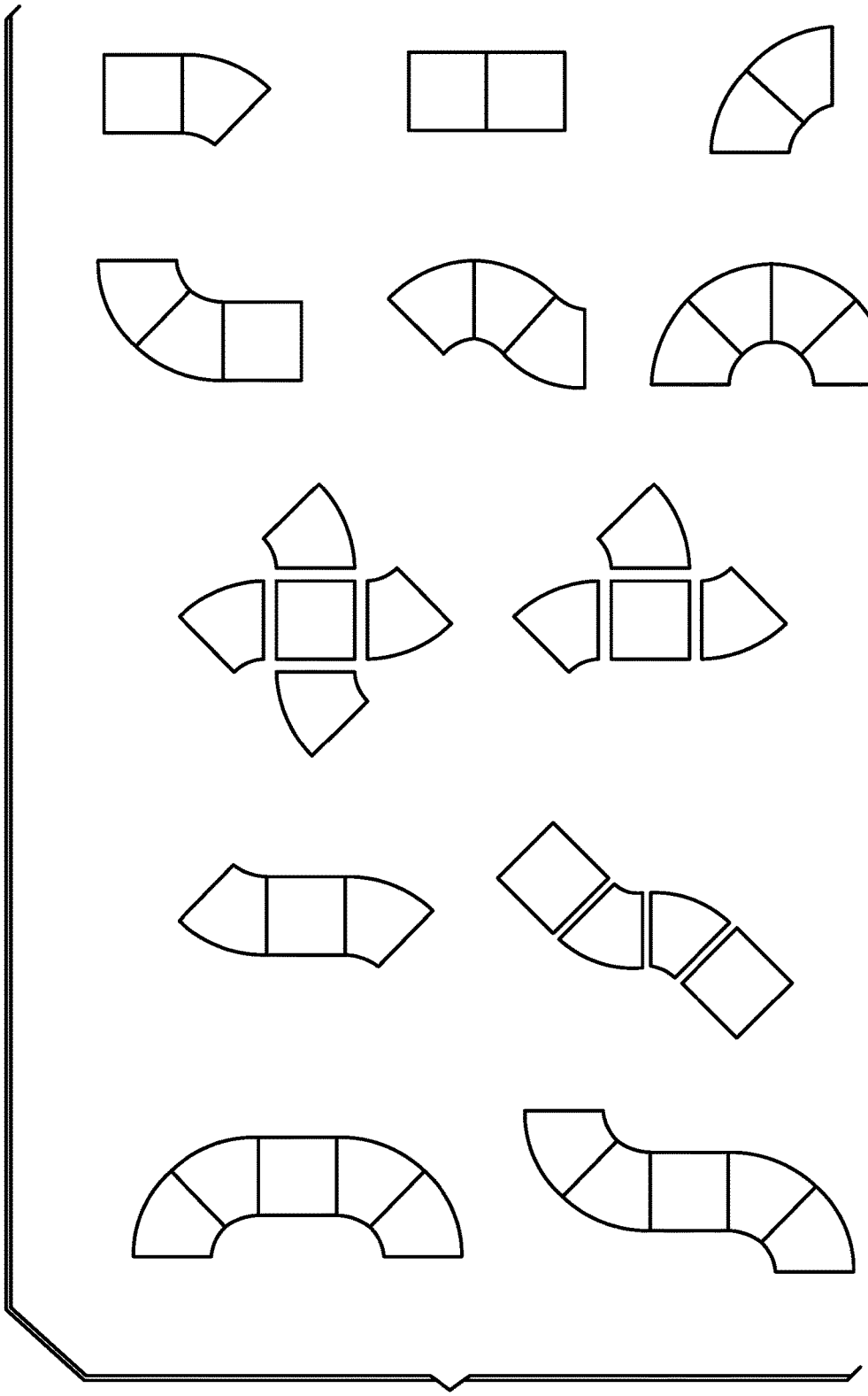
FIG. 7 is a plurality of diagrams of the shape designs of one embodiment using curved shape puzzle pieces.
Figure 8A:
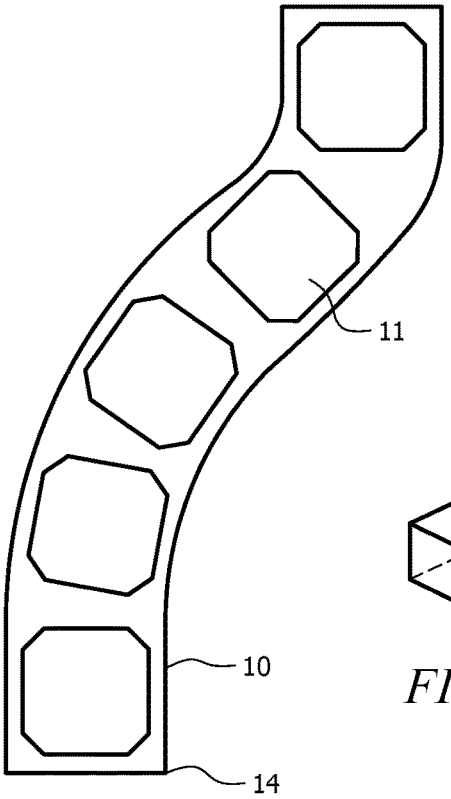
FIGS. 8 (A) through (D) are diagrams of the shape designs for the curved shape embodiment. (C) An embodiment of a tile possessing three linear edges. (D) An embodiment of a tile possessing linear and curved edges.
Figure 8B:
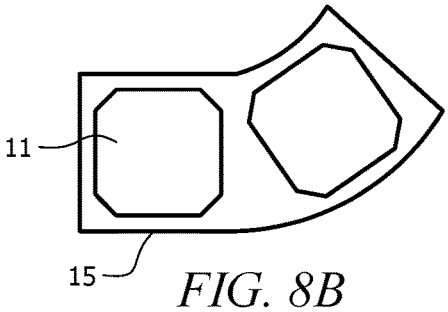
Figure 8C:
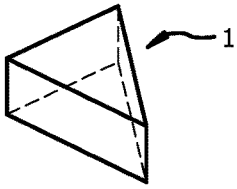
Figure 8D:
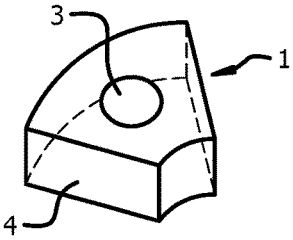

This variation uses thirty-two shapes 10 in sixteen distinct designs, as seen in FIG. 7, with curved playing pieces with a flat surface 14 on one side and a squared off edge 15 on the other side or two squared off edges, as seen in FIGS. 8(A) and (B). In some embodiments, shapes 10 are assigned varying point values ranging from one to eight. Shape cards 20, corresponding to each of shapes 10 are used to designate the point value for each shape and indicate which shapes a player is assigned to play. The games uses one hundred twenty-four tiles 1, which include one hundred four assigned letter tiles, eight "wild" letters that can be used as any letter, and twelve "block" tiles that function as a space to permit multiple words on a shape. Alternatively, tiles 1 are comprised of colors, animals, board game play icons/instructions, token pieces, icons, fruit icons, or other design known in the art. Tiles 1 can have at least three linear edges, as seen in FIG. 8(C) and FIGS. 1(A) through (K), or can have linear and curved edges, as seen in FIG. 8(D).

Figure 4C:
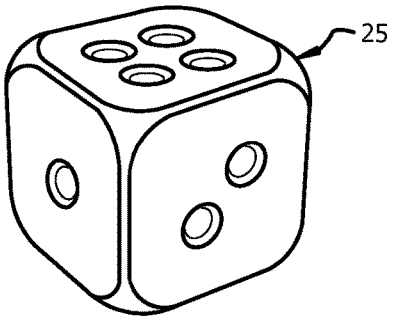

Shapes 10 are placed together on a playing surface, such as a table, ensuring there is adequate space to play and connect shapes. Tiles 1 are placed into a bag and mixed. Each player selects eight tiles from the bag and places the tiles in front of the player. Shape cards 20 are shuffled and cards dealt to each player. For four players, three cards are dealt to each player. For two or three players, four shape cards are dealt to each player. The remaining shape cards are placed on the table with obscuring face 22 facing up. Each player selects a single tile from tile bag to determine the starting player and then returns the tile to the bag. The player with the letter closest to "A", not including the wild or the block, goes first. Where tiles 1 are comprised of colors, animals, or board game play icons/instructions, players may roll dice 25, as seen in FIG. 4C, or select a shape card to determine the first player. The player with the lowest roll or score value 24 on the shape card initiates play. Alternatively, the highest roll or score value 24 on the shape card initiates play. Play moves clockwise.

During a turn, the player selects at least one shape card 20 and collects a shape corresponding to shape identifier 23 on the shape card. Shape 10 is placed on the table, with each shape played connecting to one or more shapes already played, with the exception of the first shape played in the game, to form puzzle 8, as seen roughly in FIG. 5. To successfully play a shape, tiles 1 must be placed on every tile protrusion 11 of shape 10, with a two letter minimum word or two tile minimum sequence. Shape 10 must be connected to puzzle 8 by connected a flat edge of shape 10 to a flat edge of a shape on puzzle 8, i.e. shape 10 cannot be connect to curved edge on another shape. Where shape 10 includes a squared off edge, the shape may be played in any direction on that side. Additionally, the letter on a played space "connected" shape space must be used as part of the word on the newly placed shape. Where the tiles are comprised of colors, animals, or board game play icons/instructions, the tiles must be played to form a predetermined sequence. When a "wild" tile is used, the "wild" letter is not a fixed letter during play, i.e. the "wild" tile is changed by each player connecting to the wild tile based on the player's needs. Alternatively the puzzle is used as a game path after the puzzle is completed, In such variations, the wild tile is also used as a game play device such as go to another wild tile, pull random tile to determine movement of pawn, or as a "collect a tile" if landed on or passed. Abbreviations, acronyms, proper names, or hyphened words are not permitted. Tiles 1 are selected from the player's tiles 1*a*, which are optionally stored on tile rack 9 until needed, and placed onto each tile protrusion 11 of shape 10 forming one or more words in any direction. Where the player can successfully play multiple shapes, the player continues adding shapes to the puzzle If a shape cannot be played, any or all tiles 1 or shape cards 20 may be exchanged by discarding the unwanted tiles and/or cards and selecting shape cards from the shuffled deck and tiles from the tile bag.

Upon completing a turn, the player places the shape cards representing the successfully played shapes in front of the player for later scoring. The player then replenishes the player's tiles 1*a* from the tile bag to reach eight tiles, and replenishes any played shape cards from the shape card deck. Where a player successfully connected a shape to more than one existing shape on puzzle 9, the player is given a bonus and draws an additional tile for each played shape that connected to more than one shape.

Play continues until a player has played all of that player's shape cards and the shuffled "draw" deck is exhausted, or every player is unable to place a shape in the same round. At the end of play, shape cards are used to determine score. Score value 24 on the shape cards that were successfully played are tallied, with score values on the shape cards remaining in a player's hand, i.e. unplayed shapes, at the end of the game are deducted from the total. The winner is the player with the most total points. Where two players have the same score, the tie breaker goes to the player with the highest value shape card successfully used.

In some embodiments, the paths are used as game paths in a board game after completion.

Example 11

This variation uses a turn-based game using twenty-four shapes 10 in twelve distinct designs. Twenty-four shape cards 20, corresponding to each of shapes 10 are used to indicate which shapes a player is assigned to play. The games uses one hundred twelve tiles 1, which include eight tiles for each of three indicia and four for each color combinations, and sixteen "wild" tiles. Playing pawns and a start/finish square are also used.

Shapes 10 are placed together on a playing surface, such as a table, ensuring there is adequate space to play and connect shapes. Tiles 1 are placed into a bag and mixed. Each player randomly selects ten single letter tiles from the bag and places them in front of them, forming a tile pile. The Start/Finish Square is placed on the table.

Shape cards 20 are shuffled and twelve of the shape cards randomly selected and placed on the table with obscuring face 22 facing up. The youngest player initiates gameplay. Play moves clockwise.

During a turn, the player selects the top shape card 20 and collects a shape corresponding to shape identifier 23 on the shape card. The first shaped is positioned such that a flat end of the shape is adjacent to the Start/Finish Square. The player places tiles onto the shape by matching the color or indicia on the adjacent tile. A "wild" tile may be used as any color or indicia, and can be changed for anyone connecting to the wild tile. If a player is unable to place a shape, the player may elect to exchange any or all of the tiles in the player's tile pile. The unused shape is transferred to the next player for placement. The shape card corresponding to a successfully played is discarded at the end of a turn and the player selects new tiles to replace the tiles used in successfully playing a shape.

Play continued until all the twelve shape cards have been played, or a minimum of 8 path shapes have been connected to the Start/Finish Square. The winner is the player to place a path shape that reaches from the Start/Finish square back to the Finish Square, i.e. a complete path loop is formed. There is no winner if the paths do not reach the Finish Square.

Alternatively, eighteen of the shape cards are selected and used for gameplay. Play continues as described above until all the shape cards have been played, or until a minimum of twelve path shapes have been connected and reaches the Start/Finish Square. Once the pathways are completed, the pawns are placed onto the start square and each player selects a tile from the tile bag. The player advances his or her pawn to the nearest space depicted on the drawn tile. For example, where an apple tile is selected, the player moves his or her pawn to the nearest apple tile on the pathways. If a wild is drawn, the pawn is advanced to the nearest wild space and another tile is drawn. The pawn is advanced to that space, completing the player's turn. The winner is the player to move his or her pawn to the Finish Square. At the end of a turn, the drawn tile is placed back into the tile bag.

For more challenge, all twenty-four shape cards are selected and used for gameplay. Three shape cards are dealt to each player and the pawns are placed onto the Start/Finish square. The first shaped is positioned such that a flat end of the shape is adjacent to the Start/Finish Square. The player places tiles onto the shape as described above. Where a player is unable to play a shape, the player may elect to exchange any or all the tiles in the player's tile pile, and/or shape cards. The player's pawn is advanced to the nearest color space that corresponds to the player's pawn color, except that the pawn may not advance past a wild space. Where a wild space blocks a pawn, the pawn is placed on the wild space and a tile drawn from the bag. The pawn is advanced to the nearest color depicted on the tile. Where a wild tile is drawn, the pawn is moved back to the nearest tile corresponding to the pawn's color. At the completion of a turn, the player replenishes his or her tiles from the tile bag, and selects new shape cards to replenish the played shape cards. At the end of a turn, the drawn tile is placed back into the tile bag. Play continues until all of the shape cards are used or a minimum of sixteen path shapes have been connected and connect to the Start/Finish Square. The winner is the player to move his or her pawn to the Finish Square.

Example 12

This variation uses shapes described in any of Examples 1 through 11. Shape cards 20, corresponding to each of shapes 10 are used to indicate which shapes a player or team is assigned to play. Alternatively, game play can be "free form" in that a player selects any available shape 10 for play. In some variations, paths initiate from a start location, such as start tile. The games uses tiles 1, which include one or more indicia on the indicator face, where the indicia are colors, animals, board game play icons/instructions, token pieces, icons, fruit icons, or other design known in the art. Players/teams build one or more paths using shape 10 from the start location, placing tiles on shape 10. In instances where a player or team inserts a sequence of tiles that correspond, the player or team draws another shape and continues game play until the player or team is unable to complete a shape. At that point, game play passes to the next player or team. Play can initiate as described in previous examples, such as by rolling dice.

As a non-limiting example, the game can be animal-themed, using an animal habitat start tile. The first player/team attached a shape to the start tile and places tiles having animal indicators on the face. In some variations, the start tile can alternatively be a playable shape, i.e. locations are provided on the playable shape to permit placement of tiles. Non-limiting examples include the start tile is a box-to-board playable shape, such as a mountain or other structure thematically linked to the game. The game play may include cards or instructions, such as instructions printed on the start tile, indicating which tiles can be played on a shape. In the animal example, a card can designate a series of animals or types of animals that must be played on the shape or a minimum number of animal types that must be played on the shape. Where the player or team is able to place a single type of animal congruently on the tile, such as three of a specific animal in a row, the player or team is allotted another shape to play during their turn as a bonus turn or is permitted to continue playing shapes until the player is unable to successfully play a shape. In the event a player is unable to play a tile or shape, the player loses a turn, or a tile is placed in a non-playable area of the game. For example, the animal game can include an antagonist, such as an animal poacher. Where the player cannot play a tile, the tile with the animal is placed into the poacher's tile. Playing specialty tiles or drawing specialty cards may permit the non-playable tiles to be returned to play. To further enhance the strategy aspects of the game, the animal poacher or other antagonist is placed on the next open space on any path at the end of a turn. Players can advance their pawns to an animal shape designated during their turn, such as by a play card, and advance to the next tile showing the designated animal shape. Play continues until a player completes the path, the antagonist completes the path, and/or the non-playable area of the game is filled with tiles. As a non-limiting example using the poacher, once the poacher's tile is filled with animal tiles, gameplay finishes. As such, the positioning of open spaces on various game pathways, such as ancillary paths, provides to prevent blocking of the main path and enhances the strategy and puzzle solving objectives required for the game.

Example 13

This variation utilizes the shapes and game play described in the previous examples. Tiles 1 are disposed in irregular shapes, such as shapes designed to fit onto a curved shape 10. Alternatively, tile 1 can be a non-square geometric shape, such as a triangle, circle, or hexagon. Tile 1 can also alternatively be a three dimensional shape, such as a house, castle, rock, cube, or other shape known in the art. For example, game paths can be built as described in Examples 11 and 12, with two dimensional game play tiles. Specialty tiles, such as a house, can be placed on a shape in place of a two dimensional game play tile, forming a game play obstacle or other means of effecting game play. For example, a house may provide protection from an adverse event, such as heavy rains provided during game play, as seen by a pawn arriving on an adverse event or player selecting a game play card having an adverse event. Players protected from the event gain specific advantages, such as not losing a game play turn. In some variations, the start tile, end tile, specific destination tiles provided in the game paths for game play, etc. can be three dimensional. Additionally, gameplay can include three dimensional playable shapes, such as a box-to-board obstacle or playable shape. In some embodiments the obstacle or playable shape plays as a shape, i.e. tiles can be placed on the structure to create pathways for game play. For example, the start tile, end tile, specific destination tiles can be playable shapes, such as described in Example 12. In specific embodiments, the three dimensional structures are adapted to accept tiles, allowing the game play paths to traverse the three dimensional structures.

Alternatively the tiles can be three dimensional tiles played as described in the previous examples, allowing players to match three dimensional structures, types of structures, etc.

Example 14

Figure 1J:
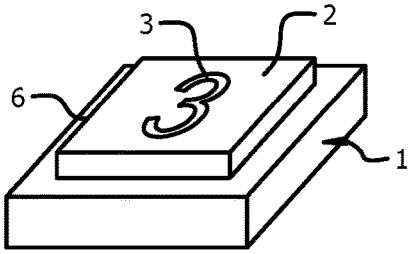
Figure 1K:
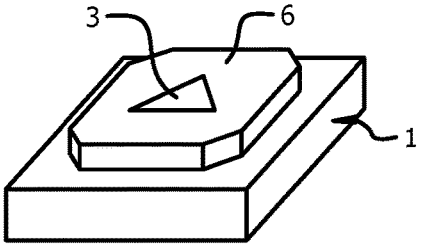

Game play and the game are as described in previous examples. However, tile 1 is adapted to accept additional tiles, allowing players to stack tiles on the shapes. In these embodiments, tile 1 includes tile projection 6 as seen in FIGS. 1(J) and 1(K). For example, where the mathematical operators are used, a player could modify an operation by stacking additional tiles onto the played piece. To illustrate this, player 1 places tiles showing "2", "+", "4", "6", player 2 can stack tiles "x" and "8" to modify the operation to read "2", "x", "4", "8". The game can also provide for stacking similar tile shapes, etc., allowing a player to create a stairs on a path, shortcut on a path, or build an elevated path to access a three dimensional shape for game play described in Examples 11 through 13. Alternatively, the tiles can be stacked based on multiple parameters of the indicia, such as by color, or icon.

Example 15

This variation of the game is as in previous examples. However, shape 10 is a geometric shape, such as a triangle, with the body of the shape segregated into smaller geometric shapes. For example, where shape 10 is a triangle, the shape can be segregated into four, triangular playable regions. In this instance, tile 1 is triangular and adapted such that four triangular tiles fit onto shape 10. Tiles can be played by placing triangular shapes adjacent to each other and playing tiles such that adjacent tiles match indicia, such as color or icon, as described previously. Where the tiles and shapes are used to form game play paths, pathways can be provided on tiles based on color, etc. In another example, shape 10 is a hexagon, with six triangular segregated parts, as described above.

Example 16

This variation of the game is as in previous examples. However, shape 10 includes one or more indicia 13 on its face that correspond to indicia on tile 1, as seen in FIG. 2(C). For a tile to be played on a space disposed on shape 10, the indicia on tile 1 must match the indicia on shape 10, by color, icon, other indicia as described above, or a combination thereof.

Example 17

Game play and the game are as described in previous examples. However, gameplay is modified by providing bonuses for not placing designated tiles, placing tiles on designated spaces, or matching a tile to an indicia on a space. For example, gameplay using a series of cat and rat tiles, provides maximizing the number of cat tiles played on a shape, while concurrently minimizing the number of rat tile played. In the event a player is able to successfully play a tile without using any rat tiles, the player received a bonus on his or her score. In alternative embodiments, a shape may include a point multiplier on the space, such as a "2×" thereby increasing the points awarded to the player using such a space.

In the preceding specification, all documents, acts, or information disclosed do not constitute an admission that the document, act, or information of any combination thereof was publicly available, known to the public, part of the general knowledge in the art, or was known to be relevant to solve any problem at the time of priority.

The disclosures of all publications cited above are expressly incorporated herein by reference, each in its entirety, to the same extent as if each were incorporated by reference individually.

While there has been described and illustrated specific embodiments of a tile on shape puzzle game and methods of play, it will be apparent to those skilled in the art that variations and modifications are possible without deviating from the broad spirit and principle of the present invention. It is also to be understood that the following claims are intended to cover all of the generic and specific features of the invention herein described, and all statements of the scope of the invention which, as a matter of language, might be said to fall therebetween.

What is claimed is:

1. A tile-on-shape puzzle game comprising:

at least one tile, wherein the tile further comprises:
- an upper face;
- a plurality of edges, where the plurality of edges is at least three linear edges, curved edges, or combination of linear edges and curved edges;
- a lower face;
- a play indicia disposed on the upper face;
- a recess disposed on the lower face;
  - wherein the recess is adapted to fit on a tile projection;
  - wherein edges of the recess are parallel to the plurality of edges of the at least one tile;
    - a plurality of lips formed by a projection bounded by the plurality of edges of the at least one tile and the recess, where a width of each of the plurality of lips have substantially the same width;
  - wherein the recess comprises:
    - a first side, a second side, a third side, a fourth side, a fifth side, a sixth side, a seventh side and an eighth side;
    - wherein the first side, the third side, the fifth side, and the seventh side are parallel to the plurality of edges and form a lip;
    - wherein the second side is disposed 45 degrees to the first side and the third side, the fourth side is disposed 45 degrees to the third side and the fifth side, the sixth side is disposed 45 degrees to the fifth side and the seventh side, and the eighth side is disposed 45 degrees to the seventh side and the first side;
    - a plurality of lips formed by a projection bounded by the plurality of edges of the at least one tile and the recess;

a plurality of playing shapes, further comprising:
- a shape surface having a first face and a second face;
- at least one tile projection disposed on the first face, wherein the tile projection further comprises:
  - an elevated surface adapted to fit in a recess disposed on the underside of the at least one tile; and
- at least one inverse tile projection disposed on the second face and corresponding to the inverse location of the at least one tile projection disposed on the first face, wherein the inverse tile projection further comprises:
  - an elevated surface adapted to fit in the recess disposed on the underside of the at least one tile.

2. The tile-on-shape puzzle game of claim 1, wherein the play indicia is a letter, number, color, an image of a shape, an image of a fruit, an image of an animal, an image of a character, icon, math equation operator, an image of a board game play icon, board game play instructions, or an image of candy.

3. The tile-on-shape puzzle game of claim 1, further comprising:
- a play determinant, where the play determinant comprises a plurality of play cards or dice;

wherein the plurality of play cards comprise an indica face and an obscuring face;

where the indicia face includes a playing shape identifier, a playing shape identifier and score value, a color indicia corresponding to a color of at least one playing shape, or a clue;

wherein the dice comprise a plurality of indica on a plurality of faces of the dice.

4. The tile-on-shape puzzle game of claim 3, wherein the plurality of playing shapes are molded in a color corresponding to the color indicia on the plurality of play cards, wherein the shape surface is molded in a color corresponding to the color indicia on the plurality of play cards and the least one tile projection is molded in a white or beige, or wherein the shape surface is molded in white or beige and the least one tile projection is molded in a color corresponding to the color indicia on the plurality of play cards.

5. The tile-on-shape puzzle game of claim 1, further comprising:

at least one tile projection disposed on the upper face of the at least one tile;

wherein the at least one tile projection on the upper face of the at least one tile is adapted to permit stacking of the at least one tile.

6. A method of playing a tile-on-shape game comprising:

providing a plurality of tiles having:

a plurality of edges, where the plurality of edges is at least three linear edges, curved edges, or combination of linear edges and curved edges;

an upper face;

a lower face;

a play indicia disposed on the upper face;

a recess disposed on the lower face;

wherein the recess is adapted to fit on a tile projection;

wherein edges of the recess are parallel to the plurality of edges of the at least one tile;

a plurality of lips formed by a projection bounded by the plurality of edges of the at least one tile and the recess, where a width of each of the plurality of lips have substantially the same width wherein the recess comprises:

a first side, a second side, a third side, a fourth side, a fifth side, a sixth side, a seventh side and an eighth side;

wherein the first side, the third side, the fifth side, and the seventh side are parallel to the plurality of edges and form a lip;

wherein the second side is disposed 45 degrees to the first side and the third side, the fourth side is disposed 45 degrees to the third side and the fifth side, the sixth side is disposed 45 degrees to the fifth side and the seventh side, and the eighth side is disposed 45 degrees to the seventh side and the first side;

a plurality of lips formed by a projection bounded by the plurality of edges of the at least one tile and the recess;

providing a plurality of playing shapes, further comprising:

a first face and a second face;

at least one tile projection disposed on the first face, wherein the tile projection further comprises:

an elevated surface adapted to fit in a recess disposed on the underside of the at least one tile; and at least one inverse tile projection disposed on the second face and corresponding to the inverse location of the at least one tile projection disposed on the first face, wherein the inverse tile projection further comprises:

an elevated surface adapted to fit in the recess disposed on the underside of the at least one tile;

mixing the plurality of tiles together, wherein the plurality of tiles are mixed in a bag or pile;

selecting a plurality of tiles from the bag or pile wherein the selected tiles form a player's tile pile;

initiating play, comprising:

orienting a first playing shape on its first face or its second face;

placing the first playing shape onto play;

placing one tile from the player's tile pile onto each play surface of the played playing shape, wherein the tile placement forms at least one word or sequence of numbers, colors, math equations, pathways, or icons on the played shape;

playing a round, further comprising:

placing a shape onto the game, wherein the shape contacts at least one other shape on the game to form a game puzzle;

placing one tile from the player's tile piled onto each play surface of the played shape, wherein the tile placement forms at least one word or sequence of numbers, colors, or icons on the played shape;

replacing the tiles in the player's tile pile;

continuing play until a scoring event is triggered, wherein the scoring event is the first player to complete use of the player's shapes, the exhaustion of cards in a shuffled "draw" deck, or every player is unable to place a shape in the same round; and determining the winner, wherein the winner is determined by completing the puzzle in a designated time, completing the puzzle before any other player, returning a player pawn to a designated finish tile before any other player, or tallying a score for each player, wherein the score is tallied using played shape cards, played shapes, or the first player to complete use of the player's shapes.

7. The method of playing a tile-on-shape game of claim 6, wherein the step of determining a winner is returning a player pawn to a designated finish tile before any other player, further comprising:

placing the pawn at a starting location on the puzzle;

advancing a pawn based on a tile indicator, an instruction on a tile, or dice indicator, wherein the pawn can be advanced to a tile containing a board game play instruction or tile indicator preventing further advancement;

completing the instructions on a board game play instruction or tile indicator to allow further advancement; and advancing the pawn to an ending location on the puzzle.

8. The method of playing a tile-on-shape game of claim 6, further comprising:

providing tiles having at least one tile projection disposed on the upper face of the at least one tile;

wherein the at least one tile projection on the upper face of the at least one tile is adapted to permit stacking of the at least one tile; and stacking tiles to alter game play paths or modify a sequence played on a shape.

9. The method of playing a tile-on-shape game of claim 6, further comprising:

providing a plurality of play cards, wherein the plurality of play cards comprise an indica face and an obscuring face and where the indicia face includes a shape identifier and score value;

shuffling the plurality of play cards;

dealing a subset of the plurality of play cards to each player; and placing the remaining play cards in a stack with obscuring face facing up;

selecting at least one shape card and collecting the shape corresponding to a shape identifier on the shape card; and playing the shape corresponding to the selected shape card.

10. The method of playing a tile-on-shape game of claim 9, further comprising playing the shape cards representing a successfully played shape; and wherein the score value disposed on the indicia face is used to tally the player's score.

11. The method of playing a tile-on-shape game of claim 10, further comprising replenishing played shape cards from the shape card deck.

12. The method of playing a tile-on-shape game of claim 6, further comprising:

placing at least a second shape onto the puzzle during a round of play, wherein the shape contacts at least one other shape on the puzzle; and placing one tile from the player's tile piled onto each play surface of the played shape, wherein the tile placement forms at least one word on the played shape.

13. The method of playing a tile-on-shape game of claim 6, wherein a player whom cannot successfully connect a shape exchanges a plurality of tiles from the player's tile pile, a plurality of shape cards, or a combination thereof.

14. The method of playing a tile-on-shape game of claim 6, wherein a player whom successfully connected a shape to more than one existing shape on puzzle, selects an additional tile for each played shape that connected to more than one shape.

15. The method of playing a tile-on-shape game of claim 6, further comprising:

providing a plurality of play cards, wherein the plurality of play cards comprise an indica face and an obscuring face and where the indicia face includes a clue;

initiating play, comprising selecting a first clue card;

selecting a plurality of tiles from the pile;

placing one tile onto a play surface of a first playing shape, wherein the tile placement forms a word on the played shape corresponding to the clue on the clue card;

playing a round, further comprising:

selecting a clue card;

selecting a plurality of tiles from the pile;

placing one tile onto a play surface of a second playing shape, wherein the tile placement forms a word on the played shape corresponding to the clue on the clue card.

16. The method of playing an aligning tile-on-shape game of claim 15, wherein the clue cards are selected from the categories "wild letter", "random letter", "before and after", "rhyme", "starts with", or a combination thereof.

17. The method of playing a tile-on-shape game of claim 6, further comprising:

providing a plurality of shape cards, wherein the plurality of shape cards comprise an indica face and an obscuring face and where a shape is disposed on the indicia face;

shuffling the shape cards;

initiating play, comprising selecting a first shape card;

selecting a plurality of tiles from the pile;

placing a shape corresponding to the shape card on the game to form a puzzle;

placing one tile onto each of the play surfaces of a first playing shape, wherein the tile placement forms a word on the played shape;

playing a round, further comprising:

selecting a shape card;

selecting a plurality of tiles from the pile; and placing a shape corresponding to the shape card on the puzzle, such that the shape is placed adjacent to a tile on the puzzle.

18. The method of playing a tile-on-shape game of claim 17, further comprising:

selecting an additional shape card if the player cannot successfully play a shape in the player's hand; and selecting additional tiles from the mixed tiles.

19. The tile-on-shape puzzle game of claim 1, wherein the plurality of edges are a combination of linear edges and curved edges;

and wherein at least two edges are linear.

20. The tile-on-shape puzzle game of claim 1, wherein the at least one tile projection on the playing shapes are an octagonal shape, a plurality of cylindrical projections, or a square.

21. The tile-on-shape puzzle game of claim 1, further comprising at least one indicia disposed on the shapes.

* * * * *